United States Patent [19]

Elser

[11] 4,126,244

[45] Nov. 21, 1978

[54] CONTAINER COMPONENT WITH EASY-OPENING WALL SECTION

[75] Inventor: William F. Elser, Toledo, Ohio

[73] Assignee: Owens-Illinois, Inc., Toledo, Ohio

[21] Appl. No.: 829,165

[22] Filed: Aug. 30, 1977

[51] Int. Cl.[2] ..... B65D 41/32

[52] U.S. Cl. ..... 220/268; 215/253

[58] Field of Search ..... 220/266–273; 215/253; 113/121 C

[56] References Cited

U.S. PATENT DOCUMENTS

| | | | |
|---|---|---|---|
| 3,499,572 | 3/1970 | Ruekberg | 220/270 |
| 3,951,298 | 4/1976 | Klein | 220/268 |
| 3,960,287 | 6/1976 | Baker | 215/253 |

*Primary Examiner*—George T. Hall

*Attorney, Agent, or Firm*—Richard B. Dence; M. E. Click; D. H. Wilson

[57] ABSTRACT

A container component with a wall section having means imparting a predefined and selectively weakened fracturable zone therein for conveniently opening the wall section in response to manually exerted force. The selectively weakened fracturable zone is provided by means of a pair of laterally interspaced channels defined in oppositely facing major sides of the wall section and which cooperate to define a fracturable partition, or bridge-wall, therebetween which extends between the oppositely facing major sides of the wall section. The channels further cooperate to impart a predefined lateral path of weakness extending therebetween through the partition. In response to manually applied force, the partition is adapted to fracture along the predefined lateral path of weakness and separate into a pair of overlapping ledges; one of which residually remains in accompaniment with each one of the resultant, residual free edges of the separated portions of the fractured wall section.

The overlap of the residual ledges which results when the wall section is fractured provides safety and ecology features which are especially desirable for containers provided with a depressible, or push-in, type of fracturable wall section, since the overlapping ledges may be arranged to obstruct removal of the depressed section from within the protective interior confines of the container after the container has been opened.

The lateral interspacing and the relative depths of the channels may be selectively and independently varied to accommodate independent selectivity and control over the resistance to fracture, or rupture, of the wall section in response to manually exerted opening forces as well as interiorly applied forces, such as would be exerted against the wall section by the confinement of pressurized or vacuumized contents within a container and also exteriorly applied forces such as might be exerted against the wall section during packaging, handling, shipment and storage of a container.

30 Claims, 11 Drawing Figures

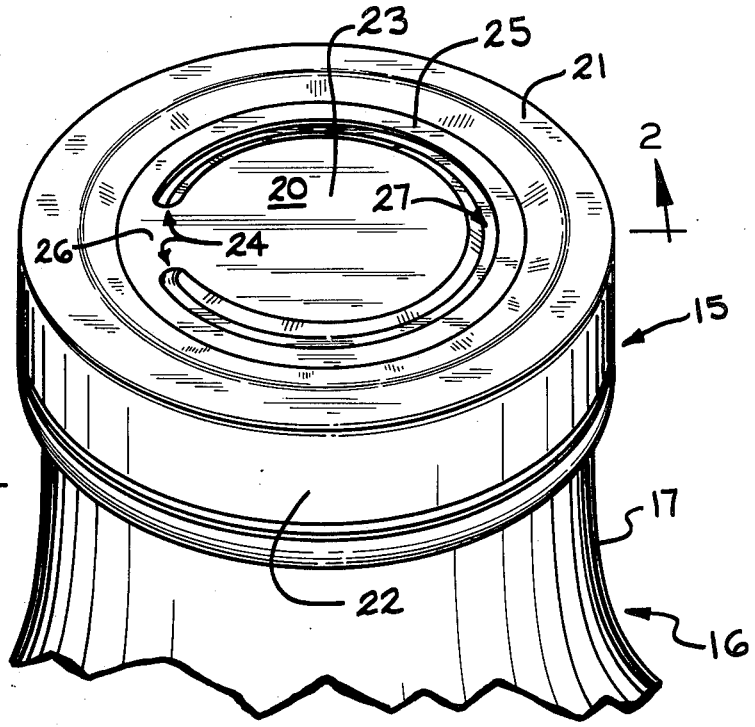
FIG. 1
FIG. 2
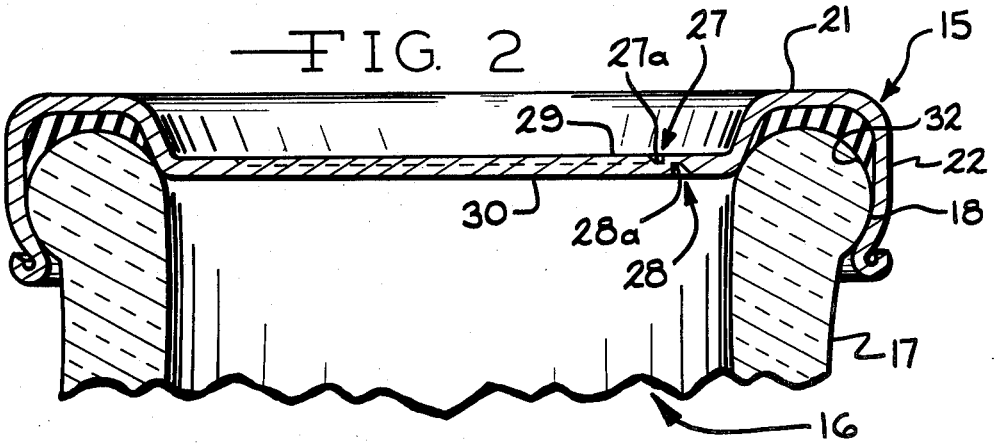
FIG. 3
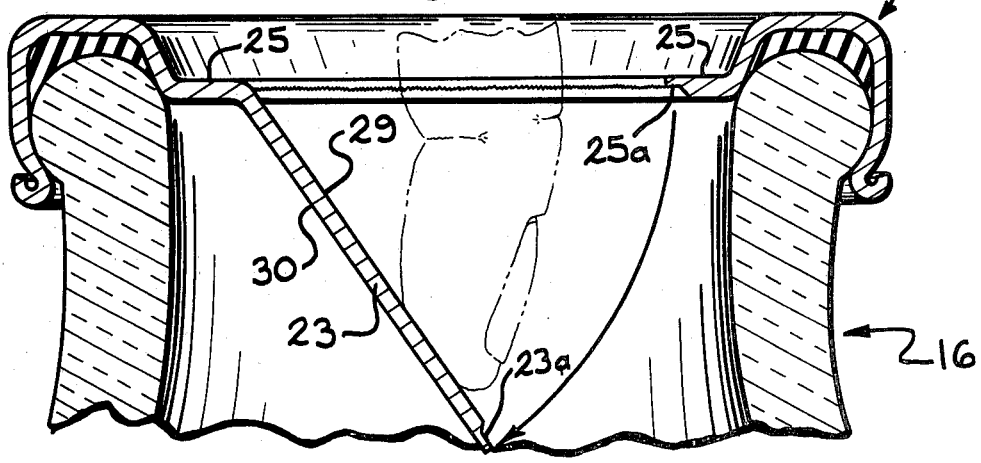

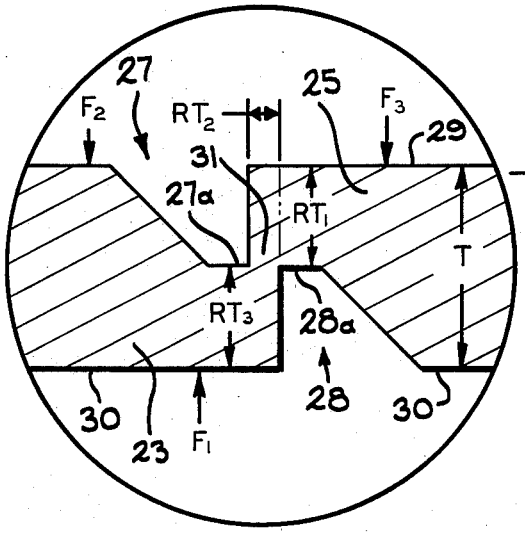
FIG. 4
FIG. 6
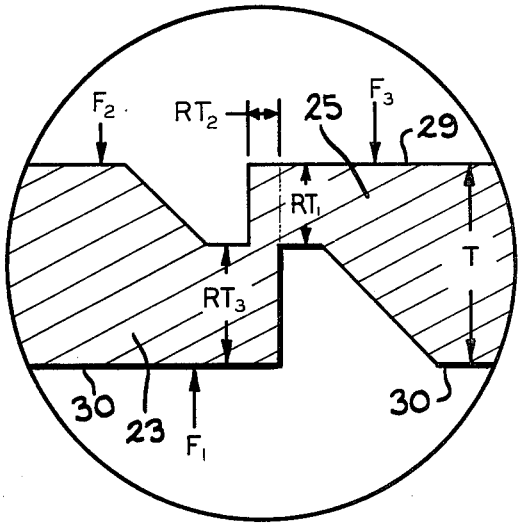
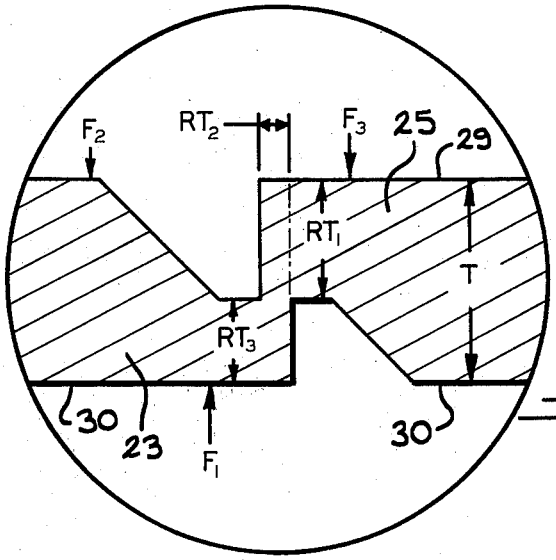
FIG. 5
FIG. 7
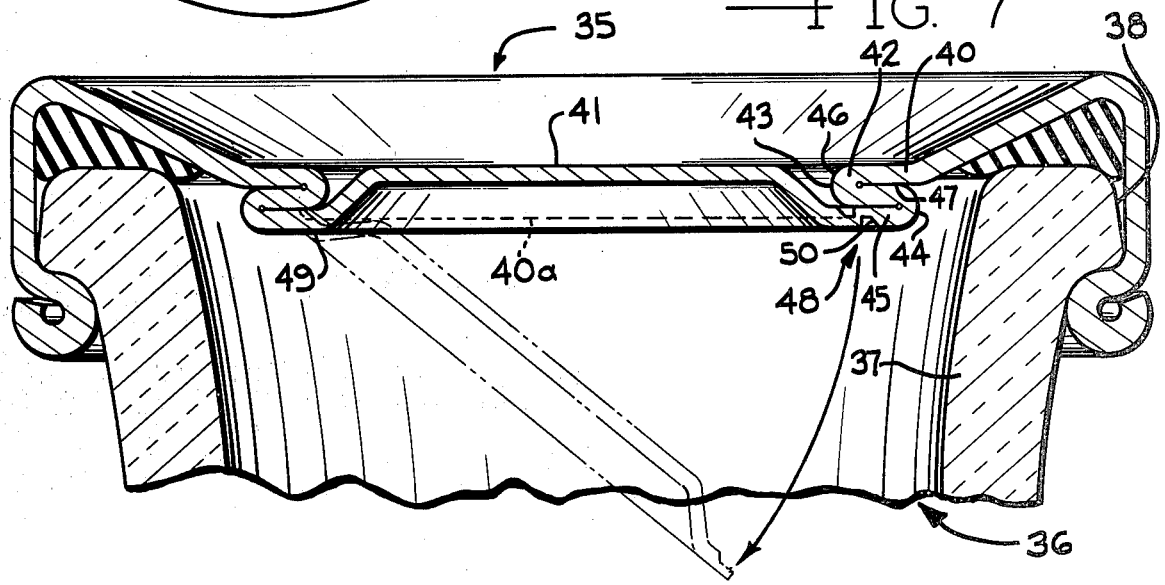

CONTAINER COMPONENT WITH EASY-OPENING WALL SECTION

BACKGROUND OF THE INVENTION

1. 'Field of the Invention

The present invention pertains to an easy-opening container component with a wall section having means imparting a predefined and selectively weakened, fracturable zone therein, which, in response to manual or digitally applied force, is conveniently fracturable to provide an outlet opening communicating with the contents of the container with which the container component is associated.

2. Brief Description of the Prior Art

The convenience afforded by easy-opening containers has led to their great popularity and widespread use for packaging a wide variety of both pressurized and non-pressurized products. This widespread usage not only includes an extensive variety of packaged products, but also various types of containers such as metal and composite cans, bottles, jars and various other types of containers. For example, it is common practice to provide metal and composite cans with end closures having a pull tab, or ring, securely attached to a score integral section of the end closure so that the scored section may be manually removed by grasping the tab, or ring, and tearing out the scored section to completely remove it from the end of the can and provide a pour-out opening. To similarly accommodate easy manual opening of bottles and jars, various forms of easy-opening closures also have been employed. To some extent, closures having generally similar types of removable tear strips and pull tabs as those commonly used for easy-opening can ends have been employed. More commonly, however, twist-off caps have been utilized, particularly for bottles destined for use in packaging carbonated beverages.

While such easy-opening containers and closures are popular and desirable from a convenience aspect their widespread use has given rise to assorted problems attending careless disposal of the removed tear strips and caps. All too frequently, such tear strips and caps are imprudently and indiscrimately discarded on the ground, along roadways and walkways, and particularly in public areas such as resorts, campsites, beaches and the like. The resulting litter is not only a nuisance and eyesore, and thus objectionable from an ecology standpoint, but constitutes a hazardous potential source of human injury. The sharp raw edges on the discarded tear strips and the sharp rims on the twist-off caps pose a danger of bodily laceration, especially to barefooted persons.

As a consequence of the littering problems, the packaging industry has directed considerable efforts towards retaining the convenience features associated with easy-opening containers while at the same time seeking ways to obviate the attendant litter problems. As an outgrowth of these efforts, various types of easy-opening structures have been devised which feature a scored segment which fractures in response to manual depression and after fracture is manually displaceable into the interior confines of the container. Ordinarily, these manually depressible, or push-in, types of easy-opening structures include an unscored region which is designed to withstand fracture and function as a hinge to retain the depressed, or pushed-in, segment integrally attached to the wall section surrounding the resultant opening in the container or closure. As thus designed, the pushed-in segment is intended to be discarded with and remain within the non-exposed confines of the container. However, in many of the push-in types of easy-opening container structures there is a potential danger of finger laceration resulting from finger contact with the residual, sharp raw edges remaining on either, or both, the pushed-in segment and the wall section from which it was separated. Moreover, there is an attendant and persistent danger in many of the push-in types of easy-opening structures that the hinge area may accidentally fail and permit the pushed-in segment to fall into the container and be inadvertently ingested during consumption of the container's contents.

Moreover, even though the manually depressible, or push-in, types of easy-opening container structures essentially avoid the tear-tab litter problem, many of the push-in types share problems and undesirable features also associated with the removable pull-tab types. Among others, containers and closures which employ scored segments frequently, upon removal of the tear-out segment, or depression of the push-in segment, leave a sharp, residual, raw edge bordering the separated segment as well as the pour-out opening. These residual raw edges are a potential source of injury during handling of the container or the consumption of its contents. Additionally, the scored region which, of course, is intentionally weakened to accommodate easy manual opening of the container, or closure, is susceptible to rupture or fracture resulting from exterior forces or stresses encountered during packaging, handling, shipping and storage. Similar susceptibility to rupture or fracture exists from interior forces or stresses exerted from within the container. Such interior forces or stresses are common with containers for packaging products which are heat pasteurized, sterilized or cooked after packaging, as well as products which are carbonated, such as carbonated beverages, or otherwise packaged in a pressurized environment within the container. On the other hand, in order to withstand the rigors of transport, handling, stacking, storage, interior pressures and other assorted sources of stress, many so-called "easy-opening" containers and closures, especially those used in packaging pressurized contents, are relatively difficult to open manually without the assistance of an accessory tool or implement. In many instances, such tools or implements are furnished securely affixed to the container. However, the inclusion of such tools or implements, of course, adds significantly to manufacturing costs, and oftentimes interferes with the handling of shelf-stacking capabilities of the container by the retailer and the consumer.

Thus, a definite need exists for providing an easy-opening structure which is capable of obviating, or substantially alleviating, the difficulties and problems associated with both the pull-tab and the push-in types of prior art easy-opening container and closure structures.

SUMMARY OF THE INVENTION

In one of its broader aspects, the present invention pertains to an easy-opening container component with a wall section having means imparting a selectively fracturable zone therein and providing a means of opening the wall section in response to manually exerted force. The means for imparting the selectively fracturable zone includes a fracturable partition, or bridge-wall, which extends between oppositely facing major sides of the wall section, and a pair of laterally interspaced channels straddling the partition, or bridge-wall, and respectively defined in the oppositely facing major sides of the wall section. The channels impart a predefined and selectively weakened fracturable zone, or path of weakness, reaching therebetween through the partition. The resistance of the fracturable zone to forces applied against either major side of the wall section, i.e. either the interiorly facing side or the exteriorly facing side, is selectively and independently variable. Thus, the resistance of the easy-opening portion of the wall section to manual opening can be selectively varied independently of the resistance of the wall section to fracture, or rupture, in response to subjection to other non-intended opening forces, or pressures, exerted against the interiorly or the exteriorly facing sides of the wall section. Contrarily, the resistance to interior forces, or pressures, can be selectively varied independently of the resistance to manual opening or other forces exerted against the exteriorly facing side of the wall section. Also, according to its broader aspects, the fracturable zone is selectively structured in such manner that during opening of the wall section, it will fracture the partition, or bridge-wall, into a pair of separate overlapping end sections, or end ledges, respectively carrying the residual, separated raw edges in locations safely disposed outside of ordinary manual reach. One of the ledges will residually remain integrally attached to the separated segment and the other ledge similarly attached to the wall section from which the separated segment departed. Additionally, the overlapping ledges obstruct counterpassing movement of the separated segment through the resultant opening formed in the wall section.

In more detailed respects, the present invention is structured in such manner that these broader aspects are readily embodiable in various types of structural container components comprising, among others, depressible, or push-in, types of easy-opening containers, including cans, jars, bottles and the like. In such embodiments, the overlapping residual ledges safely obstruct removal of the fractured segment, or panel, from within the confines of the container, even in the event that the fractured segment becomes freely separated from the wal section. Moreover, the broader concepts pertaining to the selective and independent variability of the fracture resistance of the fracturable zone of the container component, render the invention readily applicable to a wide assortment of containers such as, among others, cans, jars, bottles, etc, for packaging practically limitless products, including pressurized products.

Accordingly, a basic objective of the present invention is the provision of an easy-opening container component with a wall section having means imparting a predefined and selectively weakened fracturable zone therein characteristically having a predefined path of weakness residing in laterally disposed relationship with oppositely facing sides of the wall section to thereby cause the wall section to fracture along such lateral path when opened in response to manually exerted opening force.

Another important objective of the present invention is to accomplish the foregoing objective by the simple expedient of providing the wall section of the container component with a pair of laterally interspaced and oppositely facing channels of preselective depth and arrangement to impart a predefined path of weakness therebetween bordering the location and configuration of the desired fracturable opening in the wall section.

Another significant objective of the present invention is the provision of an easy-opening container component having a wall section with means for imparting selectively and independently variable fracture resistance to forces exerted against the interiorly facing side and the exteriorly facing side of the wall section.

Another no less important objective of the present invention is the provision of an easy-opening container component with a wall section having a predefined fracturable zone which in response to manual opening force is designed to fracture in such manner that the fracturable zone will separate into juxtaposed overlapping residual ledges thereby accommodating separation in one direction while obstructing opposite counterpassing movement of the separated portions past each other.

A further objective of the present invention is the provision of an easy-opening container component embodying the characteristics of the last-mentioned objective and which also includes an openable segment which is fracturable in response to manual depression and which will be obstructably retained within the interior confines of the container following opening of the wall section.

A further objective of the present invention is the provision of an easy-opening container component having an openable segment which may be manually depressed to provide an access opening in the container component and which is structured in such manner that the residual raw edges of the fractured wall section bordering the openable segment will be disposed in locations designed to avoid injurious manual laceration.

A still further objective of the present invention is to provide a container component with a wall section having means imparting a selectively weakened fracturable zone providing a means of opening the wall section in response to manually exerted force against the fracturable zone and which is characterized by the simple structural expedient of providing a pair of laterally interspaced channels individually located in oppositely facing sides of the wall section.

A yet further objective of the present invention is the provision of a container component characteristically embodying the features of the last-mentioned objective and which is also adapted to accommodate selective and independent variability of the rupture resistance exerted against either of the oppositely facing sides of the wall section.

Other and additional objectives, features and advantages of the present invention will become readily apparent to those ordinarily skilled in the art from the ensuing detailed description taken in conjunction with the annexed three sheets of drawings whereon certain preferred embodiments of the invention are depicted.

BRIEF DESCRIPTION OF THE DRAWINGS

FIG. 1 is a top perspective view of a container component embodying the easy-opening and ecology features of the present invention, and illustrating the container component in the form of a bottle-cap type of closure tightly secured on the dispensing end of a conventional beverage bottle; and FIG. 2 is an enlarged fragmentary sectional view taken along and in the direction of sectional plane 2—2 in FIG. 1; and FIG. 3 is a fragmentary sectional view similar to FIG. 2, but depicting the easy-opening, push-in functional aspects of the closure responsive to exertion of manual finger pressure applied against the easy-opening segment of the closure; and FIGS. 4 through 6, respectively, are magnified fragmentary sectional views depicting the selective and independent structural variability of the fracturable zone of the closure which is attainable by the present invention, and by means of which the easy-opening features of the present invention are significantly designed to provide selectively optimizable strength characteristics tailored to achieve the particular packaging requirements or needs desired; and FIG. 7 is an enlarged fragmentary sectional view similar to FIG. 3, but depicting another structural embodiment of the present invention.

DESCRIPTION OF THE PREFERRED EMBODIMENT

First Embodiment (FIGS. 1–6)

Figure 8:
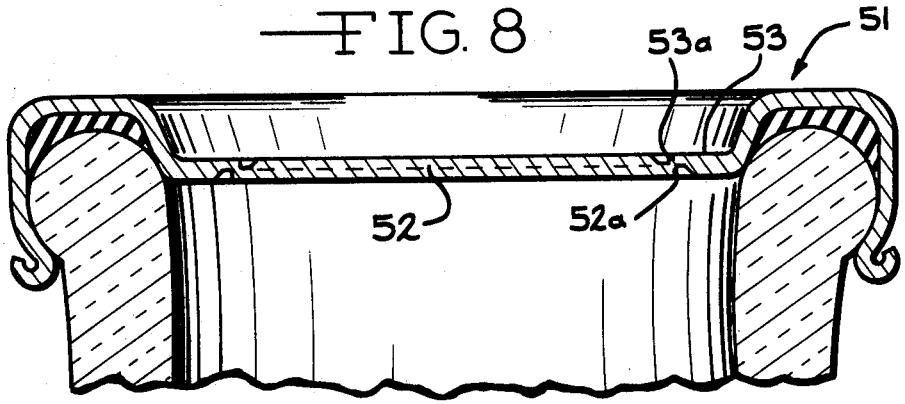
FIG. 8 is an enlarged sectional view similar to FIG. 2, but showing the closure provided with a continuous, fractionable zone accommodating total separation or detachment of the easy-opening section of the closure.

With reference to the drawings, the easy-opening container component of the present invention is, for illustrative and descriptive purposes only, shown in FIGS. 1–6 in one, among many, of the preferential forms in which it may be embodied. As depicted, the container component is shown as a closure and more particularly, as a bottle cap 15 for hermetically closing a conventional beverage bottle 16 having a neck portion 17 terminating in an exteriorly beaded rim 18 (FIG. 2) defining a dispensing opening.

The bottle cap 15 may be suitably fabricated from conventional metallic sheet material such as, among others, tin plate or aluminum, or be formed from other suitable relatively rigid material such as a plastic material, or the like, which is compatible for use as a closure. As shown, the bottle cap 15 integrally includes a central, or end wall section 20, spanning the container dispensing opening and surrounded by an annular collar, or shoulder 21, peripherally interconnecting the wall section 20 with a depending flanged peripheral skirt 22 suitably crimped, rolled, swaged or otherwise clamped tightly under the beaded rim 18 of the container 16. Preferably, the annular shoulder 21 is raised, or elevated, relative to the wall section 20 and thereby provides a base upon which to accommodate stacking of one bottle upon another while at the same time protectively shielding the wall section 20 from bearing the weight of the overlying bottle or bottles stacked thereon.

In accordance with the present invention, the wall section 20 of the bottle cap 15 is provided with an easy-opening segment which is totally integral with the wall section, and which also is at least partially separable, or fracturable, from the wall section in response to manual force, such as finger force, exerted thereagainst. This easy-opening segment is depicted in the form of a central panel section 23, which is bordered by means imparting a predefined and selectively weakened fracturable zone, as at 24, at least substantially encompassing the periphery of the panel section 23 and demarcating the panel section from the remainder of the wall section 20, which in the form shown appears as an annular, or ring-shaped, residual wall section 25 intermediately interconnecting with the panel section 23 and raised shoulder 21. Although, as will be subsequently described, the unique structural design of the fracturable zone 24 is such that it may extend continuously around and completely encompass the panel section 23, it is preferred to provide a gap in the continuity of the fracturable zone so that a non-weakened segment will be provided to resist total separation of the panel section 23 from the residual wall section 25 and remain, after fracture, to function as a bendable, or deflectable, hinge tab 26 retentively hinging the panel section 23 to the residual wall section 25.

The fracturable zone 24 is particularly designed to impart a predefined and selectively weakened path of fracture, or rupture, residing intermediate and in laterally deployed relationship with the oppositely facing major sides of the wall section 20. To this end, and as depicted in FIG. 2, one each of a pair of essentially parallel and laterally interspaced channels 27 and 28 is provided, or defined, in each of the oppositely facing major sides of the wall section 20. As shown, the channel 27 is defined in the exposed exteriorly facing major side 29 of the wall section 20 and is spaced further from the shoulder 21 of the bottle cap 15 than the channel 28, which is provided, or defined, in the interiorly facing major side 30 of the wall section. By virtue of the spacing of the channels 27 and 28 relative to the shoulder 21, channel 27, relatively speaking may be regarded as an inboard channel and channel 28 may be similarly regarded as an outboard channel and adapted to face the interior confines of the bottle 16. As thus interspaced, the inboard channel 27 and outboard channel 28 cooperate to define and straddle a fracturable intermediate bridge-wall, or partition 31, transversely spanning, or bridging, the opposite exteriorly facing and interiorly facing sides 29 and 30 of the wall section 20.

Preferably, to afford a tight-fitting hermetic seal, a conventional annular sealing gasket 32 may be suitably adhered to the underside surface of the shoulder 21 to provide a fluid-tight, hermetic seal between the bottle cap 15 and the beaded rim 18 of the beverage bottle 16. Although not shown, the interiorly facing side 30 of the wall section 20 may, if desired, be conventionally covered, or coated, with a thin plastic film and/or sealant material, in a manner well-established in the art, to protectively isolate the bottle cap from the sometimes adverse reactions resulting from exposure of the bottle cap material to certain types of products to be packaged in the associated beverage bottle.

While the longitudinal configuration of the channels 27 and 28, together with the intermediate partition 31, may, within the intents and purposes of the present invention, be varied considerably to accommodate the particular configuration desired to be imparted to the openable segment, it is generally preferred that the longitudinal configuration be arcuate, or curvilinear, and that the opposite terminal ends be at least convergent. Optionally, a substantially elliptical or, as depicted in FIG. 1, a substantially circular longitudinal configuration is favored. Also, although the relative interspacing between the channels 27 and 28, and the relative depths thereof, as will be subsequently described in greater detail with respect to FIGS. 4–6, are selectively and independently variable, certain limitations upon such variability in relation to the basic average thickness of the wall section will readily be recognized as being necessary or desirable. For purposes of description, the term "basic average thickness", as it pertains to the wall section both for this and other yet to be described embodiments, means the basic average overall thickness of the wall section in the proximity of the openable segment without taking into account the reduced thickness resulting from the channels. In this respect, it will, of course, be understood that in order to reliably provide a predefined, selectively weakened path of fracture in the wall section 20, the interspacial distance between the channels 27 and 28, on a relative basis should be substantially less than the basic average thickness of the wall section 20. Also, the total combined depths of the channels should be substantially equal to the basic average thickness of the wall section so that the bottom surfaces of the channels 27 and 28 will be disposed in substantially lateral planar alignment and thereby cooperate to define a selectively weakened plane, or path, of fracture, disposed in substantially lateral or parallel orientational relationship with the opposite major sides 29 and 30 of the wall section 20.

As best depicted in FIG. 3, forcible manual depression, such as may be exerted by finger pressure, against the exteriorly facing side of the panel section 23 will cause the panel section to fracture from the residual wall section 25 along the fracturable zone 24. By virtue of the previously described structural characteristics of the fracturable zone 24 the path of fracture will follow the predefined and selectively weakened path of fracture which reaches laterally between the bottom surfaces of the channels 27 and 28 and extends transversely through the bridge-wall, or partition 31. In so doing, the partition 31 will be transversely fractured, or segmented, into residual overlapping ledges **23*a* and 25*a* which respectively remain integrally associated with the panel section 23 and the residual wall section 25. This overlapping relationship of the residual ledges 23*a* and 25*a* provides an especially significant advantage with push-in types of easy-opening closures, since the residual ledge 25*a* overlies the residual ledge 23*a* and obstructs removal or withdrawal of the panel section 23 from the protective interior confines of the container. Thus, even in the event the hinge tab is intentionally or accidentally broken off, the panel section will remain protectively confined within the container. As a result, the panel section 23** is not susceptible to being discarded separately from the container so as to constitute a litter problem or a dangerous source of injury. Moreover, in the event of total separation of the panel section, such as by hinge failure, the obstructive retention of the separated panel section within the protective confines of the container precludes possible accidental swallowing of the panel section during consumption of the container's contents. Consequently, the present invention provides highly desirable safety and environmental features for easy-opening container components.

In further accordance with the present invention, the wall section of the container component, or bottle cap 15, is particularly structured to provide selectively and independently variable rupture, or fracture, resistance with respect to three different origins of stress; namely, (a) forces exerted against the panel section 23 to open the container component, (b) forces exerted against the exteriorly facing side of the residual wall section 25 such as are ordinarily encountered during packaging of vacuumized substances, handling, shipment, storage and stacking, and (c) forces exerted against the interiorly facing side 30 of the wall section 20 and the panel section 23 such as may result from the packaging of pressurized substances or from pasteurizing or otherwise processing substances while confined within a container. In more particular respects, and with reference to FIG. 4, the reduced thickness of the region of the wall section 20 located intermediate its exteriorly facing side 29 and the bottom surface **28*a* of the channel 28, selectively renders this region most vulnerable to fracture, or rupture, in response to shear stresses resulting from forces $F_1$, or pressures, exerted against the interiorly facing side 30 of the wall section 20. In similar manner, the reduced thickness of the region of the bridge-wall section, or partition 31, intermediate the bottom surfaces 27*a* and 28*a*, respectively, of the channels 27 and 28 selectively renders this region most vulnerable to fracture, or rupture, in response to shear stresses resulting from forces $F_2$ exerted against the panel section 23 from the exteriorly facing side 29 of the wall section for manual opening of the panel section. Additionally, the reduced thickness of the region of the wall section intermediate the bottom surface 27*a* of the channel 27 and the interiorly facing side 30 of the wall section 20 renders this region most vulnerable to fracture, or rupture, in response to shear stresses resulting from forces $F_3$ exerted against the residual wall section 25 and occasioned with a vacuum packed container, or during shipping, handling, transport, stacking, or the like. However, in accordance with the present invention, since the reduced thickness of each of these regions is selectively and independently variable, the resistance to fracture, or rupture, of each of these regions is selectively and independently controllable. Morover, the susceptibility of the wall section 20** to fracture, or rupture, can be desirably tailored to meet the widely variant packaging, shipping, handling, stacking and opening requirements and needs for a great variety of containers and container contents.

In more detailed respects, as shown in FIG. 4, the residual thickness $RT_1$ of the reduced thickness region of the wall section residing between the exteriorly facing side 29 of the wall section 20 and the bottom surface **28*a* of the channel 28 is designed to be determinative of the extent, or degree, of rupture, or fracture, resistance of the wall section 20 to pressures, or forces $F_1$, applied, or exerted against the interiorly facing side 30 of the wall section 20. On the other hand, the residual thickness $RT_2$, of the reduced thickness region of the partition 31 between the bottom surfaces 27*a* and 28*a* of the channels 27 and 28 is designed to be determinative of the extent, or degree, of rupture, or fracture, resistance of the wall section 20 to pressures, or forces $F_2$ applied, or exerted against the exteriorly facing side of the panel section 23. Further, the residual thickness $RT_3$ of the reduced thickness region of the wall section residing between the bottom surface 27*a* of the channel 27 and the interiorly facing side 30 of the wall section 20 is likewise designed to be determinative of the extent, or degree, of rupture, or fracture, resistance of the wall section to pressures, or forces $F_3$ exerted, or applied, against the exteriorly facing side 29 of the residual wall section 25 encompassing the panel section 23. With the above in mind, it will be observed in FIG. 4 that $RT_1$ and $RT_3$ are each essentially equal to one-half the basic average thickness T of the wall section 20, or, as otherwise stated, each is essentially equal to 0.5T. $RT_2$, on the other hand, is much smaller than $RT_1$ or $RT_3$ and is approximately equal to between about 0.15 and 0.20T. By way of comparison with FIG. 4, it will be seen in FIG. 5 that the residual thickness $RT_2$ has remained unchanged from that shown in FIG. 4, while the residual thickness $RT_1$ has been independently increased to provide greater rupture, or fracture, resistance to pressures, or forces $F_1$, exerted against the interiorly facing side 30 of the wall section 20. By way of comparison with FIGS. 4 and 5, FIG. 6 depicts an increase in the residual thickness $RT_3$ of the wall section 20 to thereby increase the resistance of the residual wall section 25 to exteriorly exerted pressures, or forces $F_3$, while leaving the residual thickness unchanged. Although not shown, it will be readily understood that by selectively changing the interspacial distance between the bottom portions of the channels 27 and 28 the residual thickness $RT_2$ may also be selectively and independently changed to increase or decrease, as desired, the manual force $F_2$ required to open the panel section 23. Also, although not shown, it will be clearly apparent to those ordinarily skilled in the art that the basic average thickness T may also be independently varied to accommodate selective changes in the residual thicknesses $RT_1$ and $RT_3$ independently of each other and independently of any change in the residual thickness $RT_2$. For example, the basic average thickness T of the wall section in any of FIGS. 4–6** may be alternatively increased or decreased to optionally change the residual thicknesses $RT_1$ and $RT_3$ and such increase or decrease in the basic average thickness T may be made to selectively and independently alter either one or both of the residual thicknesses $RT_1$ and $RT_3$.

Utilizing the foregoing concepts in conjunction with a container suitable for carbonated beverages, it has been found that a container component with a wall section, such as wall section 20, fabricated from a conventional sheet of aluminum alloy, such as American Aluminum Association 5182 aluminum alloy, having a basic average thickness T of about 0.010 inch, residual thicknesses $RT_1$ and $RT_3$ of about 0.005 inch each, and a residual thickness $RT_2$ of about 0.0015–0.0020 inch will provide a wall section capable of withstanding pressures of up to about 135–150 p.s.i. exerted against the interiorly facing side 30 of the wall section while accommodating only limited resistance of about 8–14 pounds manual force to fracture and open the panel section 23.

Second Embodiment (FIG. 7)

In an alternative embodiment of the invention shown in FIG. 7, the openable segment of the container component is functionally shown in both a closed position (solid line) and open position (phantom line), and is again illustratively depicted as a skirted bottle cap 35 for capping a conventional bottle 36 having a neck portion 37 provided with an externally beaded rim 38 and defining a dispensing opening over which the bottle cap is adapted to be secured in hermetically sealed relationship. In this embodiment, the innovative features of the invention previously described with respect to FIGS. 1–6 are combined with additional structural features for providing still further precautions against possible laceration occurring during manual opening of the easy-opening wall section or during subsequent use or handling of the container with which the bottle cap is associated. In providing this precautionary feature, the wall section 40 of the bottle cap 35 is formed with an offset or domed, easy-opening central panel section 41 and a continuous hemmed-under portion providing a double-folded, annular wall, or multiple walled annular collar 42, integrally interconnected with and surrounding the central, easy-opening, panel section 41. As illustrated, the annular collar 42 defines a compact sinusoidal cross-sectional configuration having reversely, or oppositely, folded inner and outer folds, 43 and 44, respectively. As so folded, the inner fold 43 is disposed in an exposed location rounding from the exteriorly facing side 46 of the wall section and the outer fold 44 is disposed in a non-exposed location underlying the interiorly facing side 47 of the wall section 40. The panel section 41 is peripherally and intergrally joined with the outer fold 44 at a fracturable location, or zone 48, disposed laterally outward from the inner reaches of the inner fold 43. As thus located, the fracturable zone is tucked under the collar 42 where the residual raw edges **40*a* of the wall section 40, when fractured, will be safely out of ordinary manual reach during opening and depression of the easy-opening panel section 41. The fracturable zone, at 48, embodies the same structural features previously described with respect to the previously described embodiment shown in FIGS. 1–6, and may be somewhat less than continuous around the panel section to provide a hinge section 49 for pivotally depressing the fractured panel section 41 downwardly into the confines of the container, as shown in phantom outline. The fractured panel section 41 will remain captively confined within the container, since, as in the previous embodiment, the residual ledge 50 of the panel section 41 will overlap the residual ledge remaining on the residual wall section 45. Moreover, such confinement will be further assured since the panel section is substantially larger than the opening peripherally defined by the inner fold 43 on the annular collar 42**.

Third Embodiment (FIG. 8)

As contrasted with the previously described embodiments, FIG. 8 depicts a bottle cap 51 which, with the exception of having a continuous fracturable zone 52 instead of a hinge, is otherwise the same as the first embodiment. As previously discussed, the structural aspects of the laterally fracturable zone are such that upon depressing and opening the easy-opening panel section 52 the surrounding residual wall section 53 and the panel section 52 will respectively retain residual overlapping ledges at **52*a* and 53*a***, respectively, which will obstruct removal of the detached panel section from the container.

Figure 9:
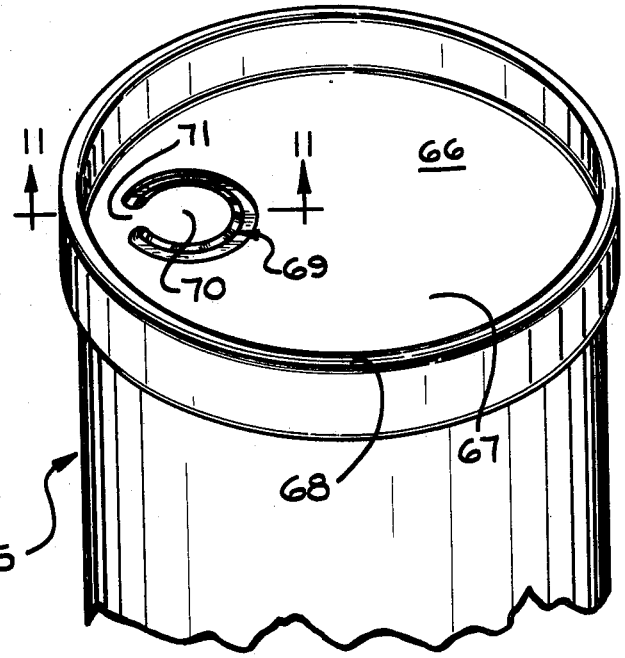
FIG. 9 is a view similar to FIG. 7, but illustrating still another structural embodiment of the present invention.

Fourth Embodiment (FIG. 9)

Another embodiment of the present invention is characterized in FIG. 9. By way of basic structural differentiation, this embodiment features a protective shoulder formed in the wall section of the container component which, like the annular collar in the embodiment shown in FIG. 7 protectively overlies the fracturable zone and obstructs manual contact with the residual, fractured, raw edges of the wall section when the wall section is opened. More particularly, the container component, which again is shown in the form of a bottle cap 55, includes a wall section 56 with an offset or domed, easy-opening, central panel 57 having an encompassing outwardly and downwardly tapered side wall 58 peripherally and integrally merging with a surrounding, raised annular shoulder 59, formed in the wall section. The annular shoulder 59 terminally merges with the panel side wall 58 to form an angular juncture at 60 at which location a selectively weakened fracturable zone is provided and structured in accordance with the previously described embodiments. When fractured, the raw residual edge remaining associated with the shoulder 59 will reside on the underside of the shoulder and thus be shielded by the shoulder from exposure to manual contact.

Figure 10:
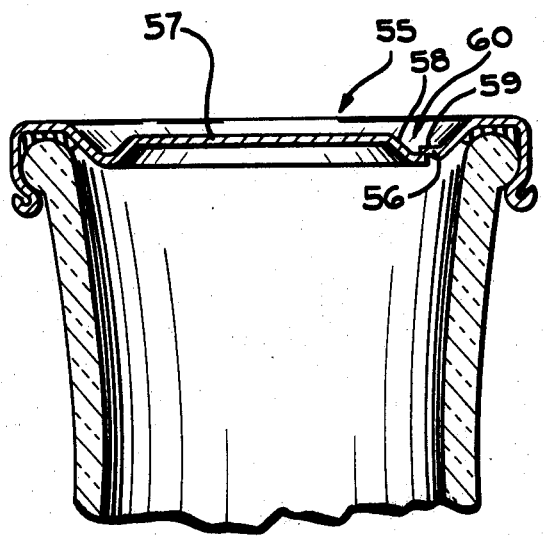
FIG. 10 is a top perspective view of the present invention incorporated in an end closure for a conventional style can.
Figure 11:
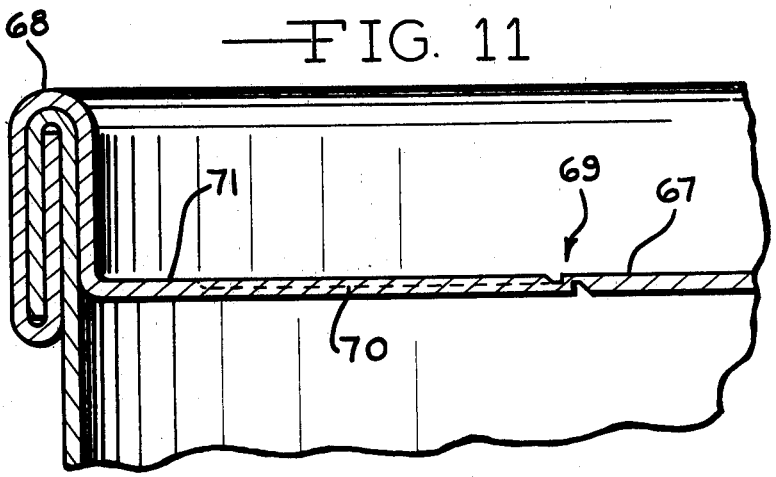
FIG. 11 is an enlarged, fragmentary, sectional view taken along and in the direction of sectional plane 11—11 in FIG. 10.

Fifth Embodiment (FIGS. 10–11)

In the embodiment illustrated in FIGS. 10 and 11, the container component is depicted as an end component for a can 65. The end component, or can end 56, includes a central wall section 67 and a raised annular rim 68 suitably secured to the can body, such as by double seaming. Defined in the wall section 67 there is a generally circular fracturable zone at 69 which is structured with laterally interspaced channels in the same manner as fully described with respect to the preceding embodiments. As shown, the fracturable zone at 69 borders and provides means for separation of an easy-opening panel section 70 defined therewithin. Preferably, as shown, the panel section 70 and bordering fracturable zone are located in proximity with the rim 68 to facilitate pouring or drinking from the can. Optionally, the continuity of the fracturable zone 69 may be interrupted to provide a non-weakened hinge section as at 71. As with the preceding embodiments, the fracturable zone 69 is selectively weakened to an extent that it will fracture in response to ordinary manual force to accommodate manual opening by depression of the panel section into the interior confines of the can.

While the present invention is particularly well-suited for container components employing a depressible, or push-in, type of easy-opening segment, or panel, it also offers significant advantages with respect to container components utilizing pull-tab types of easy-opening segments, or panels. In this regard, it is intended to be understood that the present invention also clearly contemplates a positional reversal of the pair of laterally interspaced channels in the wall section of the container component. As thus reversed, the channel defined in the exteriorly facing surface of the wall section would occupy the outboard channel position and the channel defined in the interiorly facing surface of the wall section would occupy the inboard channel position. As thus structured, manual pulling force applied to the openable segment would again follow a predefined and selectively weakened fracture path reaching between the bottom surfaces of the channels and extending transversely through the intermediate partition between the channels. Following fracture, the overlapping residual ledges remaining associated with the opened segment, or panel, and with the residual wall section will be positioned in such relative manner that the residual ledge on the opened segment will overlie the residual ledge remaining with the residual wall section and thereby avoid ledge obstruction during manual withdrawal of the opened segment. As with the preferred illustrated embodiments, the features of selectively and independently variable fracture resistance would be retained to selectively and independently vary the fracture resistance to manual force as well as to forces exerted against the interiorly and exteriorly facing sides of the wall section.

It will, of course, be understood that various details of construction, combination and assembly may be modified throughout a range of equivalents, and it is, therefore, not the purpose to limit the scope of the present invention otherwise than as necessitated by the scope of the appended claims.

I claim:

1. A container component with a wall section having means imparting a selectively weakened fracturable zone therein for providing a means of opening said wall section in response to manually exerted force against said fracturable zone, said means including a pair of laterally interspaced channels respectively defined in oppositely facing major sides of said wall section, said channels respectively having bottom surfaces disposed in substantially lateral planar alignment and cooperating to define a selectively weakened plane of fracture reaching between said bottom surfaces in substantially parallel orientational relationship with said oppositely facing major sides and along which to selectively fracture and provide and opening in said wall section in response to manually exerted force applied against said fracturable zone.

2. A container component with a wall section having means for imparting a selectively weakened rupture path encompassing a portion of said wall section and defining therewithin an integral panel section separably attached to said wall section, said means in response to manual force exerted against said panel section being adapted to rupture along said rupture path and accommodate sufficient separation of said panel section from said wall section to provide an opening in said wall section, said means including a pair of laterally interspaced channels individually defined in oppositely facing sides of said wall section and cooperating to define therebetween a bridge wall extending between oppositely facing sides of said wall section, said bridge wall and said channels together being longitudinally arranged to define the peripheral configuration of said panel section and said channels respectively having bottom surfaces disposed in substantially lateral planar alignment throughout the length thereof and cooperating to impart a lateral path of weakness extending between said bottom surfaces and passing transversely through an intermediate portion of said bridge wall to accommodate lateral rupturing of said bridge wall along said path of weakness in response to the exertion of manual force applied against said panel section and thereby separate same from said wall section and provide an opening therein.

3. A container component as defined in claim 2, wherein one of said oppositely facing sides of said wall section is adapted to provide an interiorly facing side facing the interior confines of a container and the oppositely facing side thereof is adapted to provide an exteriorly facing side, and wherein the thickness of said wall section residing intermediate said exteriorly facing side and the channel defined in said interiorly facing side constitutes a residual thickness $RT_1$ providing rupture resistance against positive forces applied to the interiorly facing side of said wall section.

4. A container component as defined in claim 3, wherein $RT_1$ is sufficient to withstand positive forces of up to about 150 p.s.i.

5. A container component as defined in claim 3, wherein $RT_1$ and the depth of said channel in the interiorly facing side of said wall section are essentially equal.

6. A container component as defined in claim 3, wherein $RT_1$ is greater than the depth of said channel in the interiorly facing side of said wall section.

7. A container component as defined in claim 3, wherein $RT_1$ is less than the depth of said channel in the interiorly facing side of said wall section.

8. A container component as defined in claim 2, wherein the thickness of said bridge wall residing between said channels constitutes a residual thickness $RT_2$ providing rupture resistance against forces applied to the panel section from the exteriorly facing side of said wall section.

9. A container component as defined in claim 8, wherein $RT_2$ is insufficient to withstand forces in excess of about 14 pounds.

10. A container component as defined in claim 3, wherein the thickness of said bridge wall residing between said channels constitutes a residual thickness $RT_2$ providing rupture resistance against forces applied to the exterior side of said wall section.

11. A container component as defined in claim 10, wherein $RT_1$ is greater than $RT_2$.

12. A container component as defined in claim 2, wherein one of said oppositely facing sides of said wall section is adapted to provide an interiorly facing side facing the interior confines of a container and the oppositely facing side thereof is adapted to provide an exteriorly facing side, and wherein the thickness of said wall section residing intermediate said interiorly facing side and the channel defined in said exteriorly facing side constitutes a residual thickness $RT_3$ providing rupture resistance against positive forces applied to the regions of the exteriorly facing side of said wall section encompassing said panel section.

13. A container component as defined in claim 3, wherein the thickness of said wall section residing intermediate said interiorly facing side and the channel defined in said exteriorly facing side constitutes a residual thickness $RT_3$ providing rupture resistance against positive forces applied to the regions of the exteriorly facing side of said wall section encompassing said panel secton, wherein the thickness of said bridge wall residing between said channels constitutes a residual thickness ($RT_2$) providing rupture resistance against positive forces applied to the panel section from the exteriorly facing side of said wall section.

14. A container component as defined in claim 2, wherein said panel section and wall section are integral portions of an end wall of a container closure.

15. A container component as defined in claim 14, wherein said panel section and wall section are integral portions of an end wall of a container closure, and wherein said closure together with said wall and panel sections are adapted to be substantially constrained against manual disassociation from said container subsequent to separation of said panel section from said wall section.

16. A container closure as defined in claim 14, wherein said container closure is in the form of a bottle cap.

17. A container closure as defined in claim 14, wherein said container closure is in the form of a can end.

18. A container component with a wall section having means imparting a predefined fracturable zone therein to provide a means of opening said wall section in response to manually exerted force against said fracturable zone, said means including a fracturable partition extending between oppositely facing major sides of said wall section, a pair of interspaced channels respectively defined in said oppositely facing major sides of said wall section and straddling said partition, said channels respectively having bottom surfces disposed in substantially coplanar alignment and imparting a predefined plane of weakness reaching between said bottom surfaces and disposed in substantially parallel relationship with said oppositely facing major sides and thereby providing a predefined fracturable zone along which to selectively fracture said partition into separate overlapping residual ledges respectively residually accompanying one each of the resultant fractured portions of said wall section, whereby said overlapping ledges function to obstruct counterpassing relative movement of said fractured portions while accommodating departing relative movement of said fractured portions to provide an opening in said wall section, and said fracturable zone being adapted to fracture in response to manually exerted force applied to said fracturable zone.

19. A container component with a wall section as defined in claim 18, wherein one of said major sides of said wall section is adapted to be an interiorly facing side and to face the interior confines of a container, and wherein the channel formed in said interiorly facing side is disposed laterally outward from the channel defined in the other major side of said wall section.

20. A container component with a wall section as defined in claim 18, wherein said wall section includes a panel therewithin integrally attached through said partition to said wall section along said predefined fracturable zone, whereby said panel is adapted to constitute one of said resultant fractured portions of said wall section and whereby said panel and said wall section respectively include one each of said overlapping residual ledges.

21. A container component with a wall section as defined in claim 20, wherein the residual ledge on said panel is adapted to underlie the residual ledge on said wall section, whereby said panel may be manually fractured and depressed towards the interior confines of a container while being obstructed against removal from said container by the overlapping residual ledge on said wall section.

22. A container component with a wall secton as defined in claim 18, wherein said channels and said partition are longitudinally aligned in essentially parallel relationship.

23. A container component with a wall section as defined in claim 22, wherein said channels and said partition define an arcuate longitudinal configuration.

24. A container component with a wall section as defined in claim 23, wherein said channels and said partition have terminally convergent end portions.

25. A container component with a wall section as defined in claim 24, wherein said channels and said partition longitudinally define substantially circular configurations.

26. A container component with a wall section as defined in claim 25, wherein the terminally convergent end portions of said channels are interspaced to provide a non-weakened intervening zone in said plane of weakness, said intervening zone being adapted to provide a hinge between said fractured portions of said wall section.

27. A container component with a wall section as defined in claim 18, wherein said wall section includes an offset panel section and a continuous hemmed-under wall providing a multiple walled annular collar surrounding and integrally interconnecting said panel section with said wall section, and wherein said means for imparting a fracturable zone provides means for fracturing said panel section from said collar to provide a means of opening said wall section.

28. A container component with a wall section as defined in claim 27, wherein said hemmed-under wall is a double folded wall comprising oppositely folded inner and outer folds, and wherein said fracturable zone is disposed laterally outward from the inner reaches of said inner fold.

29. A container component with a wall section as defined in claim 28, wherein said fracturable zone underlies said inner fold.

30. A container component with a wall section as defined in claim 18, wherein said wall section includes a domed panel section with an outwardly and downwardly tapered side wall merging with a continuous raised shoulder surrounding said panel section, and wherein said domed panel integrally interconnects with the base of said raised shoulder at the location of said fracturable zone.

* * * * *